US005766410A

United States Patent [19]

Wu

[11] Patent Number: 5,766,410

[45] Date of Patent: Jun. 16, 1998

[54] CORRUGATING MACHINE WITH AN ELASTIC PRESS PLATE

[76] Inventor: Shiung Kuang Wu, No. 231, Sec. 2, Nan Chou Rd., Lu Chou County, Tao Yuan Hsien, Taiwan

[21] Appl. No.: 711,588

[22] Filed: Sep. 10, 1996

[51] Int. Cl.[6] ..... B31F 1/20

[52] U.S. Cl. ..... 156/472; 156/470; 156/471

[58] Field of Search ..... 156/472, 471, 156/470, 473, 205, 210

[56] References Cited

U.S. PATENT DOCUMENTS

| | | | |
|---|---|---|---|
| 1,186,998 | 6/1916 | Langston | 156/472 |
| 2,525,202 | 10/1950 | Bossi | 156/471 |
| 2,979,112 | 11/1961 | Wilson | 156/473 |
| 3,676,247 | 7/1972 | Morris et al. | 156/471 |
| 4,618,394 | 10/1986 | Hoffmann | 156/473 |
| 5,389,183 | 2/1995 | Seiki et al. | 156/473 |
| 5,449,431 | 9/1995 | Isowa | 156/472 |
| 5,614,048 | 3/1997 | Barney et al. | 156/472 |
| 5,628,865 | 5/1997 | Marschke | 156/472 |

FOREIGN PATENT DOCUMENTS

| | | | |
|---|---|---|---|
| 2142591 | 2/1973 | France | 156/472 |

*Primary Examiner*—Richard Crispino
*Attorney, Agent, or Firm*—Bacon & Thomas

[57] ABSTRACT

A single facer corrugating machine for improving the gluing effect of the medium paper and the liner includes an elastic press plate for supplying a suitable pressure on the medium paper and the liner after the former is coated with glue on one side, a pressure chamber and a heating plate for providing a suitable pressure and prolonged heating to the glued sheet of medium paper and liner to make them more firmly glued together. The pressure chamber and the heating plate are disposed downstream of the lower corrugating roll and the primary preheating roll in a direction of travel of the glued sheet of medium paper liner. The pressure chamber is filled with a suitable pressure so that the medium paper and liner are more firmly glued together when they are fed between the pressure chamber and the heating plate and are subjected to suitable pressure and heating.

2 Claims, 4 Drawing Sheets

CORRUGATING MACHINE WITH AN ELASTIC PRESS PLATE

BACKGROUND OF THE INVENTION (a) Field of the Invention

The present invention relates generally to an improved single facer, and more particularly to an improved corrugating machine in which the corrugating medium paper and liner may be firmly glued together and the paper materials may not be damaged during production.

(b) Description of the Prior Art

Corrugating paper boards comprise liner board and a corrugated medium paper glued together. They are used in making corrugated boxes and packing boards for shock-absorbing purposes. Corrugating machines for forming single-face corrugated paper boards are the chief machinery in corrugating lines. The subject of the present discussion is the manner of sticking the liner and the corrugated medium in single-face corrugated paper board making. FIG. 1 shows a conventional corrugating machine B. A sheet of medium paper A1 and liner A2 are respectively fed into the machine B (single facer) via different entrances. They are passed round a corrugating roll set C and a pressure roll set D respectively and then round a gluing roller set E to be glued together as a singled-face corrugated paper board A. The medium paper A1 is flat when it is fed via a preheating roll C3 into an interface between a upper corrugating roll C2 and a lower corrugating roll C1 where it is corrugated. The corrugated medium paper A1 is then coated with glue by the gluing roller set E and adhered to the liner A2. The liner A2 is heated by a preheating roll D2 before it is passed round the pressure roll D1 to adhere to the corrugated medium paper A1. The liner A2 and the corrugated medium paper A1 are adhered and pressed together by means of glue and relative pressure of the pressure roll D1 and the lower corrugating roll C1.

The major disadvantage with the conventional corrugating machine (single facer) is that the continuous corrugations on the surface of the lower corrugating roll C1 may pierce through the medium paper A1 and the liner A2 when they are on the pressure roll D1. Under high speed rotation, the pressure roll D1 may vibrate, resulting in possible creases or cracks in the liner A2, hence lowering the strength of the corrugated paper boards thus formed. And since the relative pressure of the pressure roll D1 and the lower corrugating roll C1 is utilized, the corrugated medium paper A1 and the liner A2 are pressed and heated just for an instant where the two rolls meet, poor gluing effects may result. It is often necessary to slow down the production process to allow a longer period to heat the medium paper A1 and the liner A2, which not only affects production efficiency but also increase costs.

SUMMARY OF THE INVENTION

Accordingly, a primary object of the present invention is to provide an improved single facer in which lower corrugating roll and a primary preheating roll are spaced a suitable distance apart from each other, and an elastic press plate is disposed between the lower corrugating roll and the primary preheating roll to impose a suitable pressure on the glued corrugated medium paper and liner along the direction of travel thereof so that they may stick together firmly without damaging the paper material.

Another object of the present invention is to provide an improved corrugating machine (single facer) in which a large area heating plate is disposed near an elastic press plate disposed between lower corrugating roll and a primary preheating roll, and a pressure chamber is arranged opposite to the heating plate and is spaced a suitable distance apart therefrom such that when the chamber is filled with a suitable pressure, the glued corrugated medium paper and liner passing between the pressure chamber and the heating plate as a whole may lie closer against the heating plate so as to achieve firm gluing effects, thus increasing production efficiency and lowering costs.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
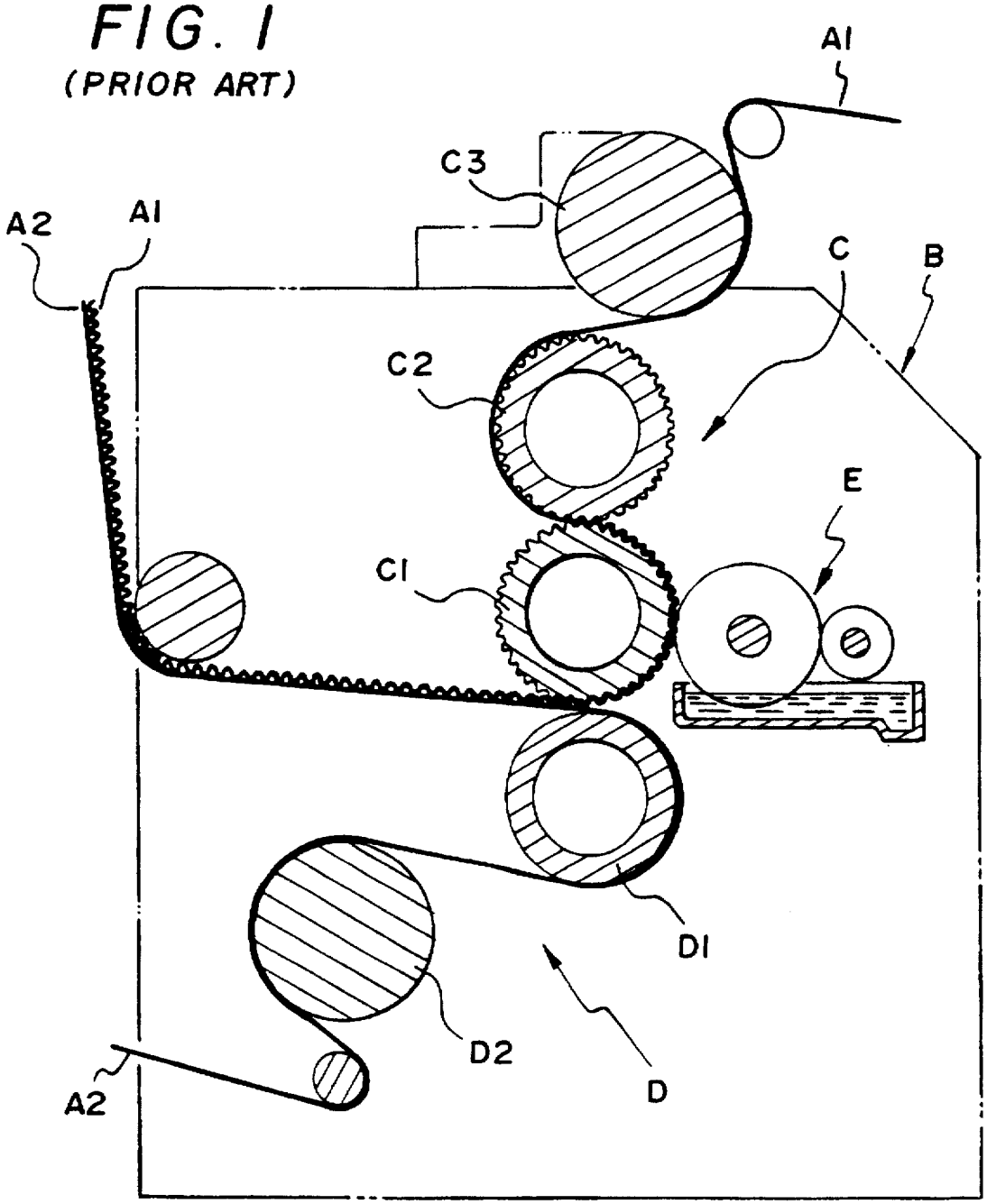
FIG. 1 (PRIOR ART)
FIG. 1 is a schematic view of the conventional corrugating machine.
Figure 2:
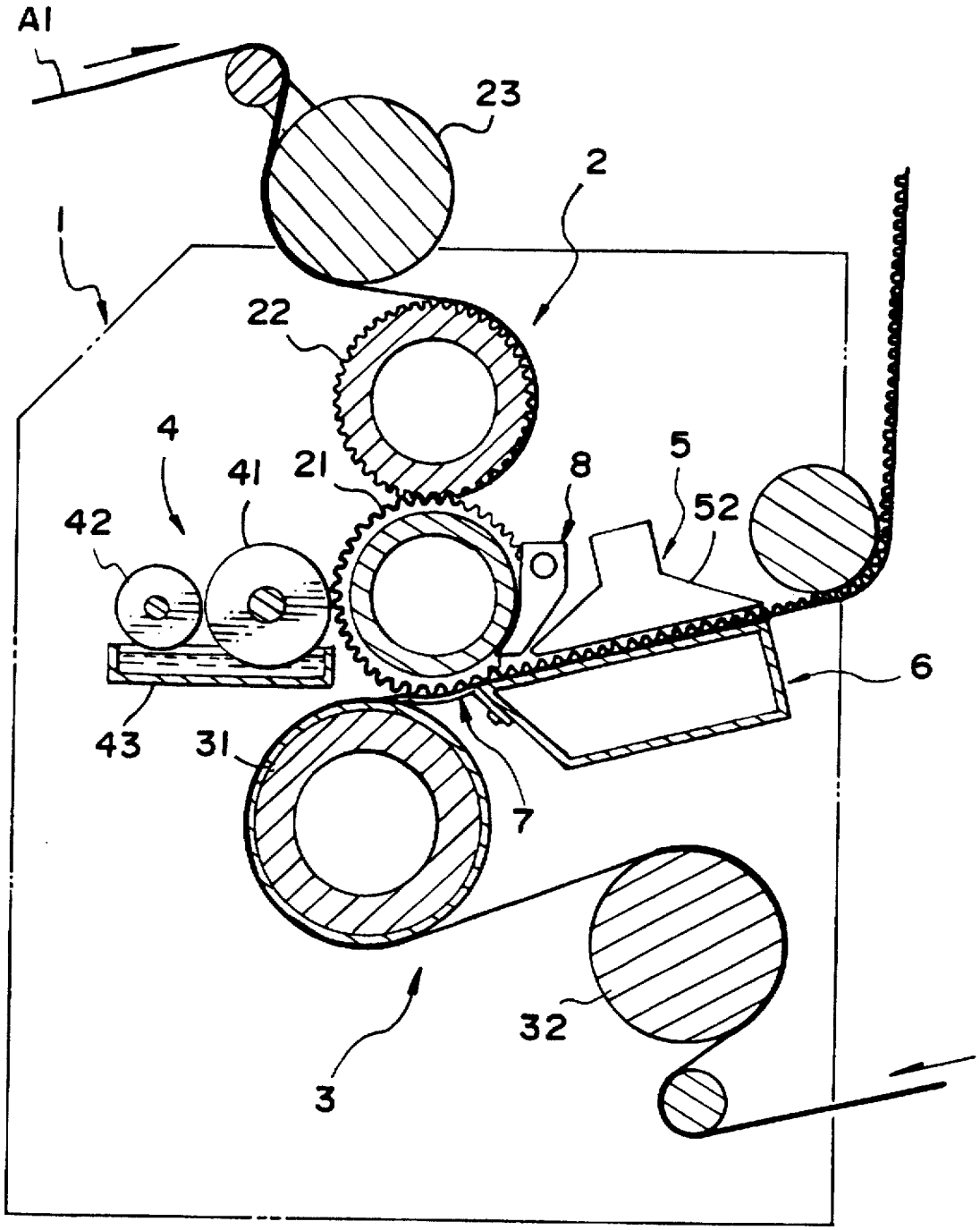
FIG. 2 is a schematic plan view of the present invention.

With reference to FIG. 2, the improved corrugating machine (single facer) according to the present invention is essentially directed to forming a single-face corrugated paper board with improved gluing mechanism in which medium paper material is fed into the machine and pressed by corrugating rolls into a corrugated medium paper which is coated with glue material before being adhered to liner and fixed in shape as a single-face corrugated board. Basically, the corrugating machine comprises a machine body 1 accommodating therein a corrugating roll set 2, a pressure roll set 3, a gluing roller set 4, a pressure chamber 5, a heating plate 6, an elastic press plate 7 and a guide block 8. A sheet of medium paper A1 is fed via the corrugating roll set 2 and then the gluing roller set 4 where it is coated with glue. A sheet of liner A2 is fed via the roll set 3 where the elastic press plate 7 will lift up the liner A2 from the surface of a primary preheating roll 31 and then cause the sheet of medium paper A1 and the liner A2 to be pressed together at a curved section of a primary corrugating roll 21. The guide block 8 will then separate the combined sheet of medium paper A1 and liner A2 from the lower corrugating roll 21 and the former is fed along the direction of pull into an interface between the pressure chamber 5 and the heating plate 6 to receive a uniform and greater area of heating so that the medium paper A1 and the liner A2 may stick firmly together and then discharged via a conveying device.

The corrugating roll set 2 includes a preheating roll 23 having heating effects, an upper corrugating roll 22, and the above-mentioned lower corrugating roll 21, both of which have an outer surface provided with continuous corrugations whereby they engage each other. The sheet of medium paper A1 is originally a flat, planar sheet. After being pressed by the upper corrugating roll 22 and the lower corrugating roll 21, it becomes corrugated.

The roller set 3 includes a secondary preheating roll 32 and the above-mentioned primary preheating roll 31, both of which have a smooth outer surface. After the liner A2 is fed into the corrugating machine (single facer) of the present invention, it is starched and heated by the the secondary preheating roll 32 and the primary preheating roll 31 before it is adhered to the medium paper Al by glue. The gluing roller set 4 is mounted at one side of the lower corrugating roll 21 and includes a glue tray 43 for containing glue used for sticking the medium paper A1 and the liner A2. Above the glue tray 43 are mounted the above-mentioned gluing roller 41 and a doctor roller 42. The gluing roller 41 is dipped in the glue solution so that its outer surface is coated with a layer of glue when it rolls. The doctor roller 42 is disposed next to the gluing roller 41 for scraping excessive glue on the gluing roller 41 by adjustment of the distance between the doctor roller 42 and the gluing roller 41. The gluing roller 41 lies against one side of the lower corrugating roll 31 and may roll relatively thereto so that the glue may be spread on the medium paper A1.

Figure 3:
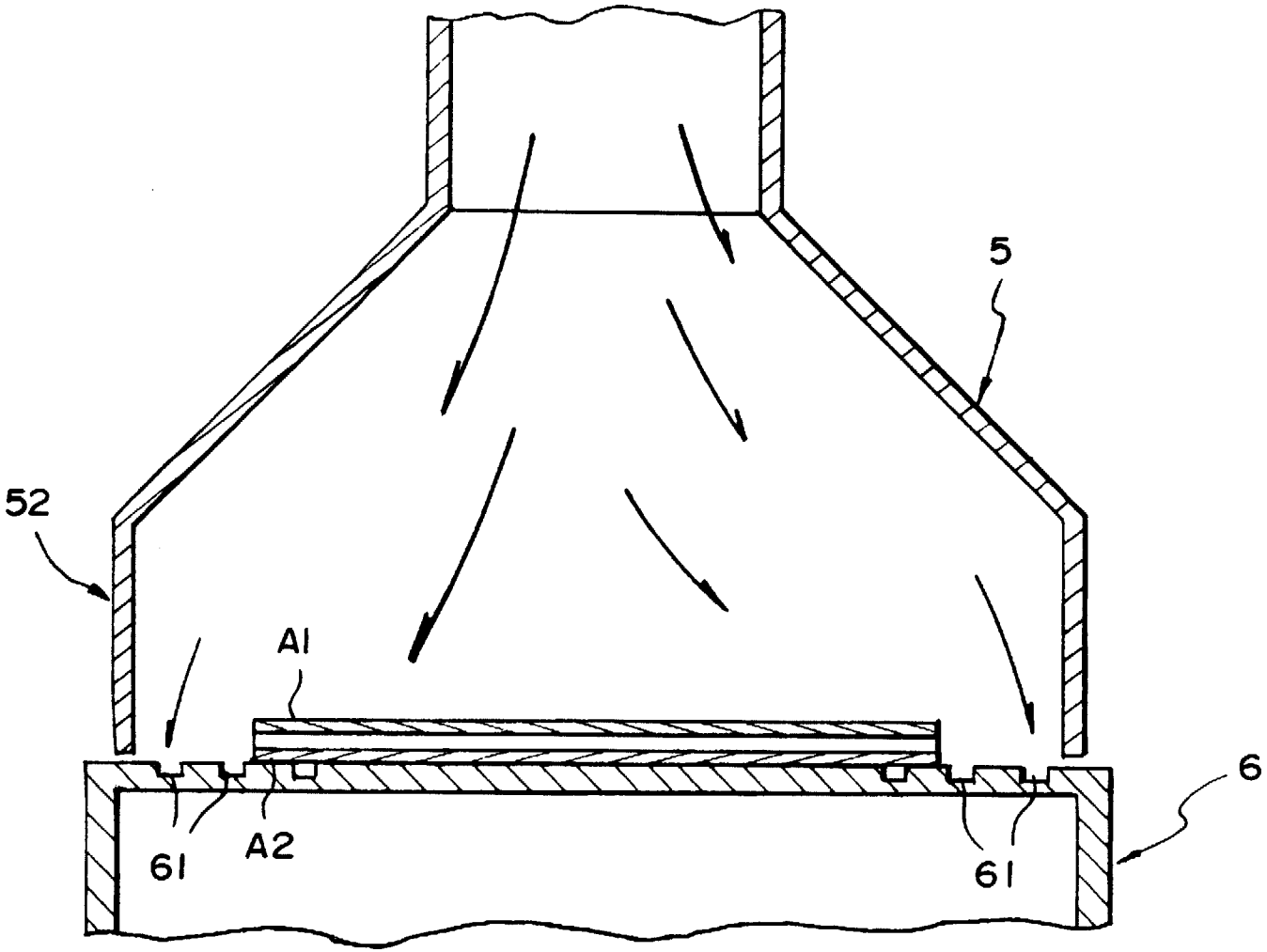
FIG. 3 is a sectional view of a pressure chamber and a heating plate.

As the description above is largely known in the art, the relevant driving device and structure are not discussed in detail herein. The formed medium paper A1 and the liner A2 are subjected to the pressure of the primary corrugating roll 21 and the primary preheating roll 31 respectively before they are glued together. Since the lower corrugating roll 21 and the primary preheating roll 31 are suitably spaced apart from each other, they will not press the corrugated paper thus formed. The elastic press plate 7 that extends from the heating plate 6 to the preheating roll 31 has a shape matching the surface curve of the lower corrugating roll 21 so that it may resiliently press thereagainst. The guide block 8 is concealed in an annular groove of the lower corrugating roll 21 in a position lower than that of the corrugations thereof so that it may separate the formed medium paper A1 from the surface of the primary corrugating roll 21. The pressure chamber 5 and the heating plate are disposed to the rear of the primary preheating roll 31. The medium paper A1 and the liner A2, after being pressed to stick together at the elastic press plate 7, enter between the pressure chamber 5 and the heating plate 6 such that the pressure chamber 5 is on the outside of the medium paper A1 while the heating plate 6 is on the outside of the liner A2. Referring to FIG. 3, the pressure chamber 5 includes a chamber body 52 shaped like a lamp-shade and having an opening facing the heating plate 6. When the chamber body 52 is filled with suitable air pressure, the medium paper A1 and the liner A2 are caused to rest close against the heating plate 6 so that they may stick firmly together. The purpose of such an arrangement is to accelerate congelation of the glue between the medium paper A1 and the liner A2 by use of relatively long heating so as to increase production capacity.

Figure 4:
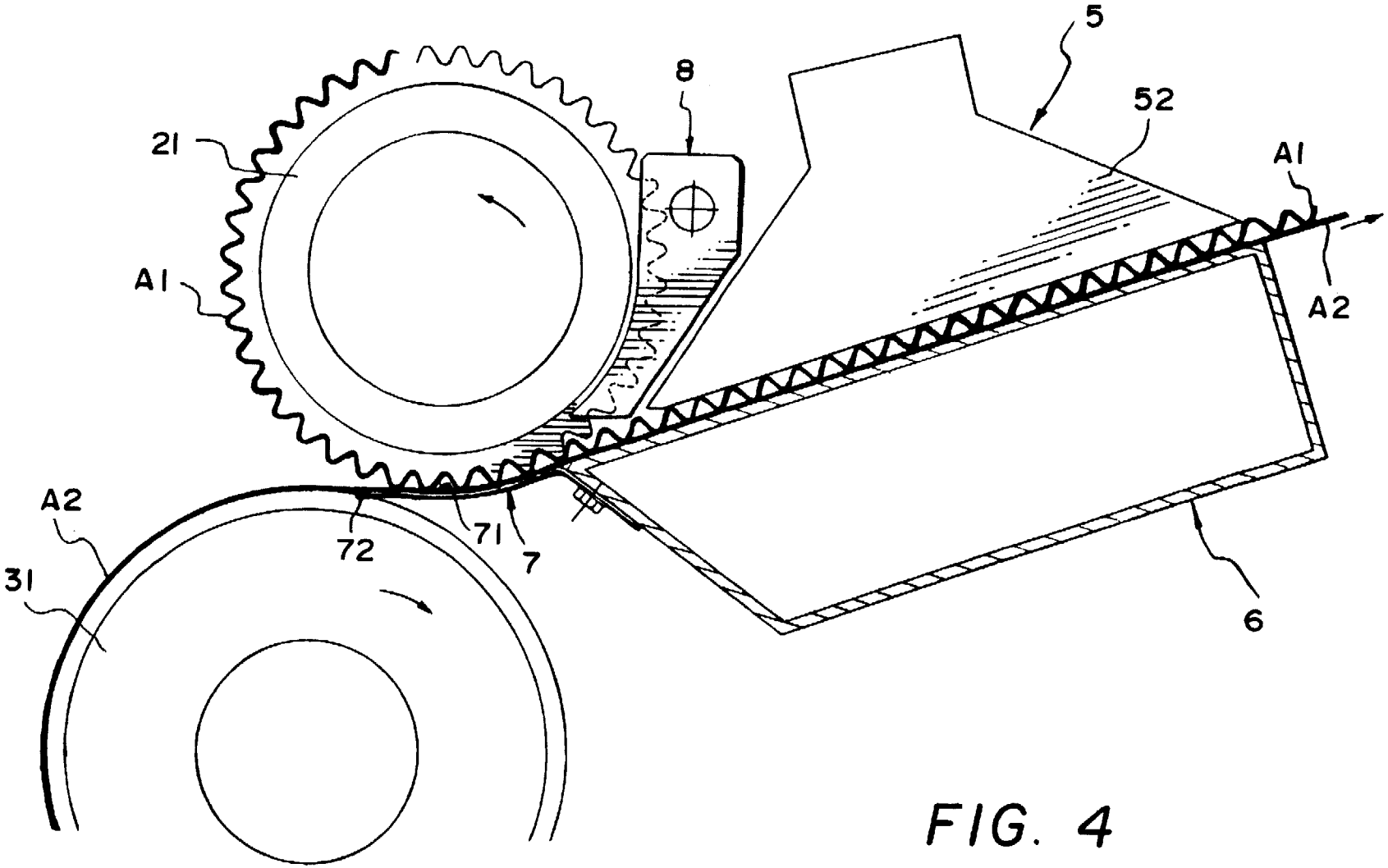
FIG. 4 illustrates the state of the corrugated medium paper and the liner during the gluing operation.

With reference to FIG. 4, the elastic press plate 7 disposed behind the lower corrugating roll 21 and the primary preheating roll 31 is provided with a curved surface 71 which resiliently press against one side of the lower corrugating roll 21. A rear end of the elastic press plate 7 is provided with a smooth folded portion 72 that resiliently presses against the surface of the primary preheating roll 31 at a point for lifting the liner A2 off the surface of the primary preheating roll 31 so that the liner A2 may disengage from the primary preheating roll 31 in a tangential direction. The guide block 8 has a curved surface lying close to an annular groove 24 (having no corrugations) of the lower corrugating roll 21 for separating the medium paper A1 from the lower corrugating roll 21 at this point so that the medium paper A1 may disengage from the lower corrugating roll 21 in a tangential direction. The medium paper A1 and the liner A2 thus formed and glued together are moved along by the actions of the lower corrugating roll 21 and the primary preheating roll 31 and are respectively separated therefrom by the elastic press plate 7 and the guide block 8; the pressure exerted by the press plate 7 on the lower corrugating roll 21 enables the liner A2 and the medium paper A1 to stick together at a curved section of the lower corrugating roll 21 before they are fed as a whole between the pressure chamber 5 and the heating plate 6 for further pressing and heating.

As shown in FIG. 4, showing the glued state of the medium paper A1 and the liner A2, in which the glue sticks to the tip of each corrugation of the medium paper A1. When the medium paper A1 is adhered to the liner A2, the glue sticks them together. By subjecting them to the pressure of the press plate 7 and the lower corrugating roll 21 and subsequently the pressure of the pressure chamber 5 and heating by the heating plate 6, they are firmly glued together.

The improved corrugating machine according to the present invention has the following advantages over the prior art:

1. The lower corrugating roll 21 and the primary preheating roll 31 are suitably spaced apart from each other so that they will not press the medium paper A1 and the liner A2 simultaneously. That the elastic press plate 7 digs up the liner A2 from a top end of the primary preheating roll 31 and pushes the liner A2 towards the medium paper A1 with its curved surface 72 along the curve of the lower corrugating roll 21 by means of its resilient pressure enables gluing of the medium paper A1 and liner A2 to form corrugating paper boards without damaging the paper materials.
2. The arrangement of a larger area pressure chamber 5 and heating plate 6 to press and heat the medium paper A1 and the liner A2 on a larger area in a uniform manner enables the medium paper A1 and the liner A2 to be glued together more firmly. The disadvantage with the prior art in which the liner A2 is easily damaged due to concentrated stress when the lower corrugating roll C1 with pointed corrugations and the pressure roll D1 together press thereupon and corrugated paper boards of insufficient strength are formed may be eliminated.

The arrangement of the pressure chamber 5 and the heating plate 6 provide a longer heating to the glued medium paper A1 and liner A2 to speed up congelation of the glue so as to enhance production efficiency and thus lower cost. On the contrary, in conventional corrugating machines (single facers), the short period of heating at the point between the pressure roll D1 and the lower corrugating roll C1 often does not achieve satisfactory gluing effects. In order to provide a longer heating period, it is necessary to extend the time each corrugation of the lower corrugating roll C1 passes the circumferential surface of the pressure roll D1, thus slowing down the production process and increasing cost.

Although the present invention has been illustrated and described with reference to the preferred embodiment thereof, it should be understood that it is in no way limited to the details of such embodiment but is capable of numerous modifications within the scope of the appended claims.

What is claimed is:

1. A single facer corrugating machine comprising a machine body containing a corrugating roll set for corrugating a paper sheet, a gluing roller set for applying glue to a paper sheet corrugated by the corrugating roll set, a pressure roll set adjacent to the corrugating roll set to press a liner sheet against the corrugated sheet glued by the gluing roller set, a pressure chamber and a heating plate located downstream of the corrugating roller set in the direction of travel of a corrugated paper sheet and a liner sheet, an elastic press plate extending between the heating plate and the pressure roller set, and a guide block located adjacent to the corrugating roll set, wherein a sheet of medium paper is fed through said corrugating roll set to be rolled into a sheet of corrugated paper which is applied with glue by said gluing roller set, and a sheet of liner is fed through said pressure roll set while being held taught, said medium paper and said liner being pressed together by said elastic press plate so that they are glued together and then being conveyed between said pressure chamber and said heating plate to be subjected to heat and pressure to make them firmly glued together wherein said press plate is disposed downstream of a lower corrugating roll of the corrugating roll set and a primary preheating roll of the pressure roll set, the press plate having a curved surface resiliently pressing against a curved surface of said primary preheating roll for separating the liner conveyed between said lower corrugating roll and said primary preheating roll from said primary preheating roll in a tangential direction, said guide block having a curved surface lying closely adjacent to an annular, uncorrugated groove in said lower corrugating roll for separating the medium paper from said lower corrugating roll in a tangential direction.

2. The single facer corrugating machine as claimed in claim 1, wherein said pressure chamber and said heating plate are disposed downstream from said lower corrugating roll and said primary preheating roll along a direction of travel of the glued sheet of medium paper and liner, said pressure chamber having an elevated pressure so that the medium paper and liner are firmly glued together when they are fed between said pressure chamber and said heating plate.

* * * * *